US010748727B2

(12) United States Patent
Wong

(10) Patent No.: US 10,748,727 B2
(45) Date of Patent: Aug. 18, 2020

(54) ELECTRICAL SWITCH

(71) Applicant: Mei Mei Memie Wong, Hong Kong (CN)

(72) Inventor: Mei Mei Memie Wong, Hong Kong (CN)

( * ) Notice: Subject to any disclaimer, the term of this patent is extended or adjusted under 35 U.S.C. 154(b) by 15 days.

(21) Appl. No.: 15/992,926

(22) Filed: May 30, 2018

(65) Prior Publication Data

US 2019/0371555 A1 Dec. 5, 2019

(51) Int. Cl.
*H01H 67/06* (2006.01)
*H01H 63/34* (2006.01)

(52) U.S. Cl.
CPC ..... *H01H 67/06* (2013.01); *H01H 63/34* (2013.01)

(58) Field of Classification Search
CPC ..... H01H 67/06; H01H 63/34
USPC ..... 200/19.06, 19.07, 19.18, 19.2, 543–546, 200/413, 418, 420, 423, 329
See application file for complete search history.

(56) References Cited

U.S. PATENT DOCUMENTS 2,523,077 A * 9/1950 Unterschuetz ..... H01H 17/00 200/423
4,766,277 A * 8/1988 Bigelow, Jr. ..... H01H 3/36 174/545
8,362,378 B2 * 1/2013 Wong ..... H01H 17/22 200/329

* cited by examiner

*Primary Examiner* — Edwin A. Leon
*Assistant Examiner* — Lheiren Mae A Caroc
(74) *Attorney, Agent, or Firm* — Leydig, Voit & Mayer, Ltd.

(57) ABSTRACT

An electrical switch has a casing, fixed contacts and at least one moving contact located in the casing, and a rotor supported in the casing for rotation about an axis of rotation to move the moving contact into and out of contact with at least one of the fixed contacts. There is also an operating mechanism for rotating the rotor. The fixed contacts are arranged on one side of the rotor with respect to the axis of rotation.

31 Claims, 5 Drawing Sheets

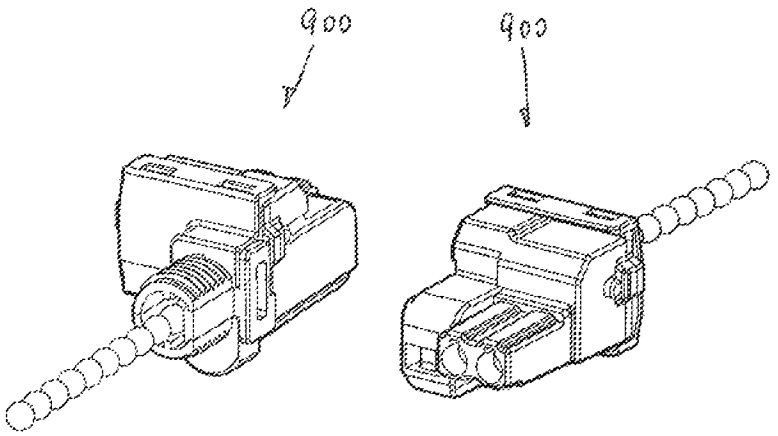
FIG. 11
FIG. 12
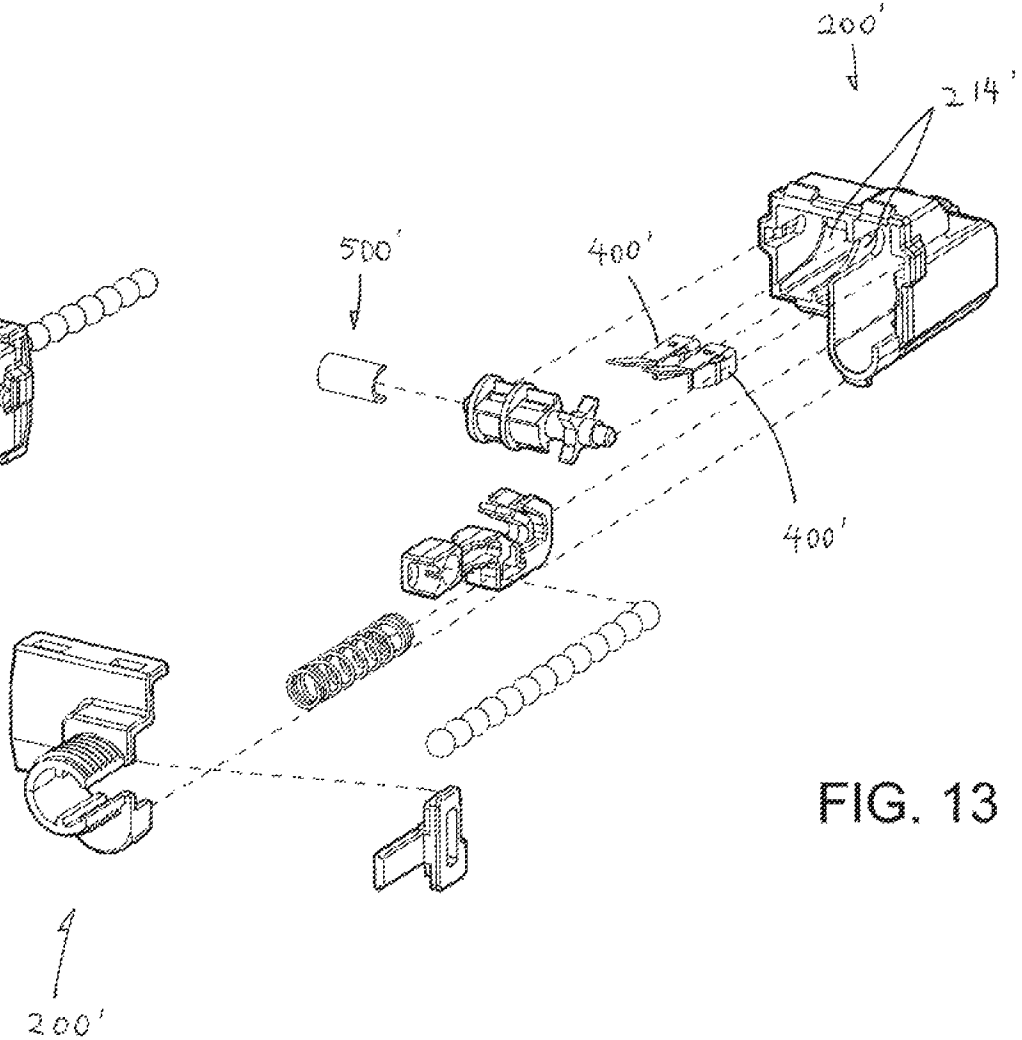
FIG. 13

ELECTRICAL SWITCH

The present invention relates to an electrical switch that incorporates an internal rotor for switching.

BACKGROUND OF THE INVENTION

Electrical switches of the kind concerned are often known as rotary stepping switches. In a typical construction, the switch has a casing, a rotor, a moving contact mounted on the rotor, and a plurality of fixed contacts disposed around the rotor for contact by the moving contact for switching as the rotor is rotated in a stepwise manner by pulling a chain or the like.

There are a number of problems associated with such switches. The arrangement of fixed contacts around the rotor imposes limitations on the design of the switches and in particular makes it hard to alter the number of the fixed contacts vis-à-vis the design of the casing or to install more than four to five fixed contacts. By being connected to the switch in different directions around the latter's periphery, electrical cables are cumbersome to be arranged or run in a confined space.

The invention seeks to mitigate or at least alleviate the aforesaid problems or shortcomings by providing an improved or otherwise new electrical switch.

SUMMARY OF THE INVENTION

According to the invention, there is provided an electrical switch comprising a casing, a plurality of fixed contacts and at least one moving contact provided in the casing, and a rotor supported in the casing for rotational advancement about an axis of rotation to move the moving contact into or out of contact with at least one of the fixed contacts, thereby performing a switching action. There is also an operating mechanism for rotationally advancing the rotor. The fixed contacts are arranged on one side of the rotor with respect to the axis of rotation.

Preferably, the fixed contacts are arranged in one row extending in a first direction substantially parallel to the axis of rotation.

More preferably, the fixed contacts are aligned with one another in the first direction.

More preferably, the fixed contacts are located at regular intervals in the first direction.

It is preferred that at least one of the fixed contacts is elongate and extends transversely to the axis of rotation.

It is further preferred that said at least one fixed contact has opposite first and second ends and is supported at the first end for pivotal movement at the second end by the rotor.

Advantageously, the fixed contacts have substantially the same construction and are arranged in a regular manner.

It is preferred that the moving contact extends across all of the fixed contacts for performing switching actions with the fixed contacts at different times and/or in different combinations.

In a preferred embodiment, the moving contact is carried by and movable with the rotor.

More preferably, the rotor has a cavity in which the moving contact is located, the cavity having at least one open region through which the moving contact is exposed and contactable by an associated fixed contact.

Further more preferably, the cavity includes at least one closed region for covering and blocking the moving contact from being contacted by the associated fixed contact.

Yet further more preferably, the open region and the closed region associated with the same fixed contact together extend circumferentially with respect to the rotor.

Yet further more preferably, the open region and the closed region associated with each of the fixed contacts together extend circumferentially with respect to a corresponding section of the rotor, and all such sections are arranged in a row along the axis of rotation of the rotor, with the open regions offset as between adjacent sections.

Yet yet further more preferably, the rotor includes an annular flange extending between and separating adjacent open and/or closed regions.

Preferably, the rotor includes at least one inclined protrusion for abutment by an associated fixed contact against rotational reversal upon release of the operating mechanism.

Preferably, the rotor includes at least one inclined protrusion for abutment by an associated fixed contact against rotational reversal upon release of the operating mechanism, which inclined protrusion extends in the direction of the axis of rotation and on and along an edge of the closed region.

It is preferred that the cavity has an open end relative to the axis of rotation, through which open end the moving contact is inserted into the cavity, whereby the moving contact is located in the cavity for rotation with the rotor about the axis of rotation.

It is preferred that the moving contact has a part-cylindrical body and is fixed to the rotor in a co-axially manner.

It is further preferred that the part-cylindrical body has a cross-section that extends about the rotor over an angle exceeding 180°, and preferably about 270°.

In a preferred embodiment, the operating mechanism includes ratchet means in ratchet engagement with a rotor part of the rotor, a manually-operable member for operating the ratchet means in a driving direction to advance the rotor, and first resilient means resiliently biasing the ratchet means to return in a non-driving direction opposite to the driving direction.

More preferably, the ratchet means is supported for linear motion in opposite directions transversely of the axis of rotation.

More preferably, the ratchet means comprises a ratchet member arranged to engage the rotor part in the driving direction upon operation by the manually-operable member and to skip the rotor part in the non-driving direction under the action of the first resilient means.

Further more preferably, the ratchet member is pivotable against the action of a second resilient means to skip the rotor part in the non-driving direction.

Yet further more preferably, the ratchet member includes a rigid support for rigidity while engaging the rotor part in the driving direction.

In a specific construction, the rotor part comprises an annular arrangement of protrusions on the rotor around the axis of rotation.

More specifically, the rotor part is provided at one end of the rotor.

It is preferred that the manually-operable member comprises an elongate pliable member connected with the ratchet means.

It is further preferred that the elongate pliable member is releasably connected with the ratchet means at a junction.

It is yet further preferred that the casing has a part which is openable to reveal the junction for connecting or disconnecting the elongate pliable member.

In a preferred arrangement, the casing has on opposite first and second sides thereof a plurality of openings, with one of the openings on the first side through which the manually-operable member is exposed for manipulation by a user and the other openings on the second side through which electrical cables may be inserted for connection to the fixed contacts respectively.

In a preferred embodiment, the casing has a first compartment holding the fixed contacts and the moving contact and a second compartment holding the operating mechanism.

More preferably, the first compartment is partitioned into separate rooms interconnected by a common area, with each room holding a respective fixed contact and the common area holding the rotor.

Further more preferably, the rooms are oblong in shape and extend in a co-parallel manner.

Further more preferably, the rooms have the same shape and size and are aligned with one another.

In a specific construction, the casing has a first casing part including the first compartment and the second compartment, and a second casing part that closes upon the first casing part, together forming the casing.

More specifically, the second casing part has an integrally-connected tube through which the manually-operable member extends out of the casing for manipulation by a user, the tube being externally screw-threaded and co-operable with an internally screw-threaded nut for mounting the overall electrical switch to a part or housing of an electrical appliance for controlling its operation.

BRIEF DESCRIPTION OF DRAWINGS

The invention will now be more particularly described, by way of example only, with reference to the accompanying drawings, in which:

FIG. 11 is a front perspective view of a second embodiment of an electrical switch in accordance with the invention;

FIG. 12 is a rear perspective view of the electrical switch of FIG. 1; and FIG. 13 is an exploded perspective view of the electrical switch of FIGS. 11 and 12, showing all its internal components.

DETAILED DESCRIPTION OF THE INVENTION

Figures 1, 2, 3:
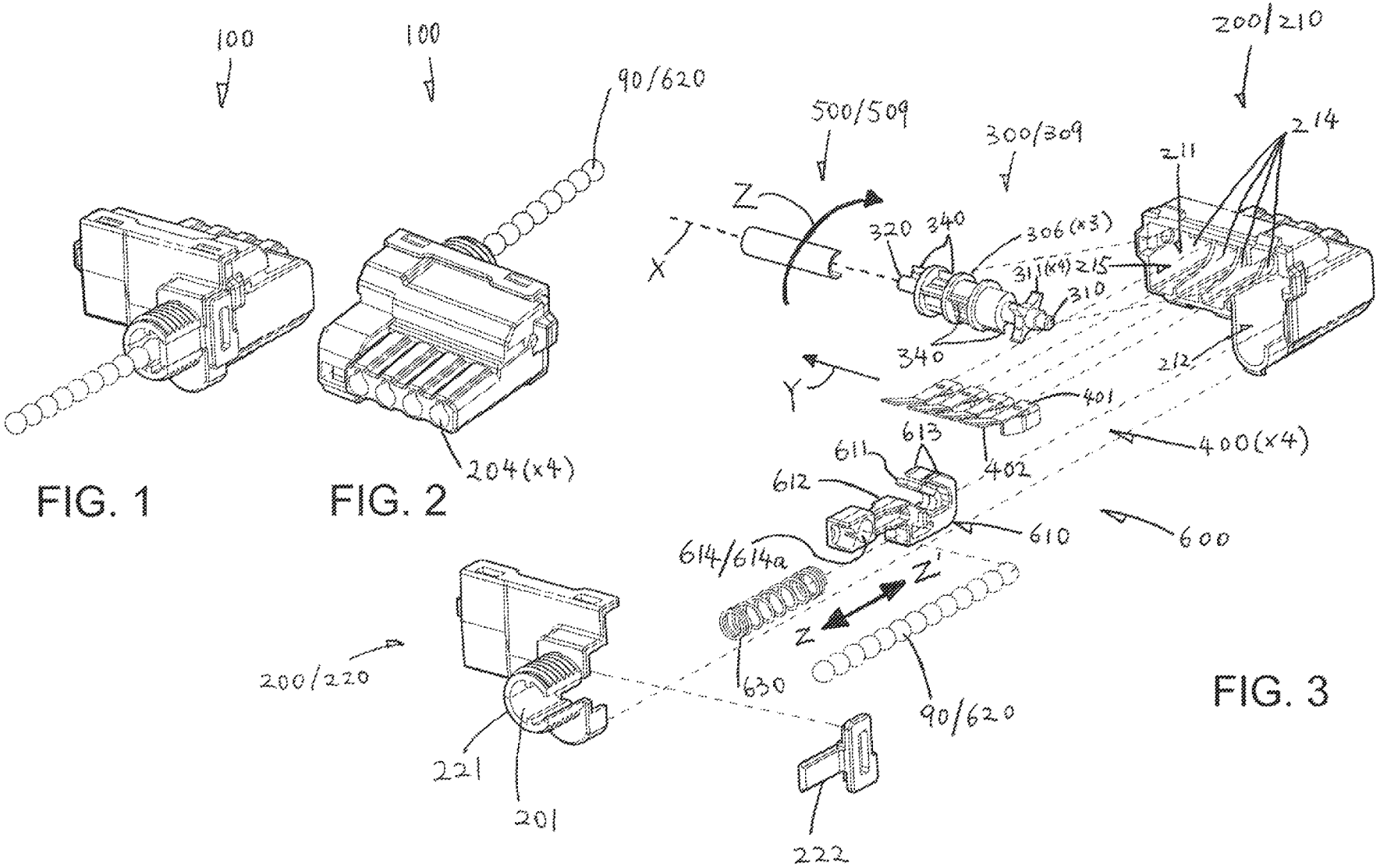
FIG. 1 is a front perspective view of a first embodiment of an electrical switch in accordance with the invention.
FIG. 2 is a rear perspective view of the electrical switch of FIG. 1.
FIG. 3 is an exploded perspective view of the electrical switch of FIGS. 1 and 2, showing all its internal components.
Figure 4A:
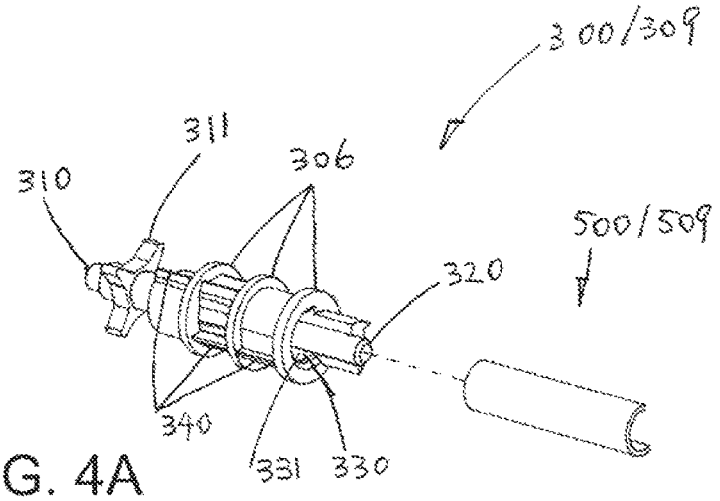
FIGS. 4A, 4B and 4C are perspective views of a rotor and a moving contact of the electrical switch of FIG. 3, illustrating how the moving contact is fitted with the rotor.
Figure 4B:
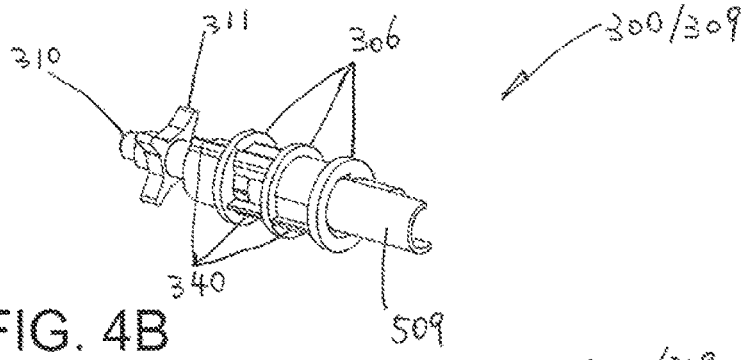
Figure 4C:
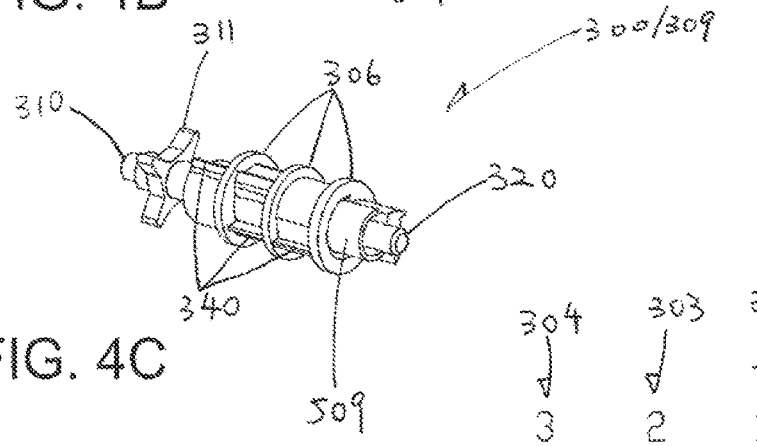

Referring initially to FIGS. 1 to 10 of the drawings, there is shown a first electrical switch embodying the invention, which takes the form of a stepping switch 100 operated by means of a beaded metal pull chain 90 or a string or any suitable elongate pliable member, also commonly known as a pull-chain switch. The electrical switch 100 has a casing 200, a plurality of, e.g. four, fixed contacts 400 and at least one, e.g. one, moving contact 500, all provided in the casing 200. The electrical switch 100 includes a rotor 300 supported in the casing 100 for rotation, and in particular rotational advancement, about an axis of rotation X to move the moving contact 500 into or out of contact with at least one of the fixed contacts 400, e.g. all four fixed contacts 400, thereby performing a switching action. Also housed in the casing 200 is an operating mechanism 600 for rotating i.e. advancing the rotor 300.

The fixed contacts 400 are arranged on one, and one single, side (e.g. the lower side in FIG. 3) of the rotor 300 with respect to the axis of rotation X. The fixed contacts 400 are arranged in one, and only one single, row extending in a first direction Y substantially parallel to the axis of rotation X. The fixed contacts 400 are aligned with one another, and located at regular intervals, in the first direction Y.

At least one, e.g. each, of the fixed contacts 400 is elongate and extends transversely to the axis of rotation X. Each fixed contact 400 has opposite first and second ends 401 and 402 and is supported at the first end 401 for pivotal movement at the second end 402, resembling a lever, by the rotor 300. The fixed contacts 400 have substantially the same construction and are arranged in a regular manner, e.g. at regular intervals and mutually aligned end-to-end.

In operation, the fixed contacts 400 bear with their second ends 402 upon the rotor 300 and/or the moving contact 500 supported by the rotor 300.

The rotor 300 has a generally cylindrical body 309 with opposite first and second ends 310 and 320 and a central axis coincident with the axis of rotation X. The rotor body 309 is formed with a part-cylindrical cavity 330 sharing the same central axis with the rotor body 309, or co-axial about the central axis. The cavity 330 is formed at a small depth underneath the outer surface of the rotor body 309, has an open end 331 at the rotor's second end 320 relative to the central axis, and extends about the central axis over an angle of about 270°.

The moving contact 500 is carried by, and located on, the rotor 300 for movement i.e. rotation with the rotor 300. The moving contact 500 has a part-cylindrical body 509 which has a cross-section that extends about the rotor 300 over an angle of about 270° for circuit connection, or generally an angle exceeding 180° in a different embodiment. The moving contact 500 is inserted into the cavity 330 of the rotor body 309 along the axial direction, via the cavity's open end 331, as is shown in FIG. 5A. The cavity 330 is made to match and fix the moving contact 500 therein, such that the moving contact 500 is fixed co-axially in the cavity 330 for rotation with the rotor 300 about the axis of rotation.

The rotor body 309 integrally includes a series of three annular flanges 306 at regular intervals along the central axis, thereby dividing the rotor body 309 into a row of four sections 301, 302, 303 and 304. The cylindrical surface of each section is divided into four equal regions A, B, C and D. While being looked at in a schematic developed view, the entire cylindrical surface of the rotor body 309 is divided into sixteen (16) regions 305 that are arranged in a 4×4 array (FIG. 5).

Figure 5:
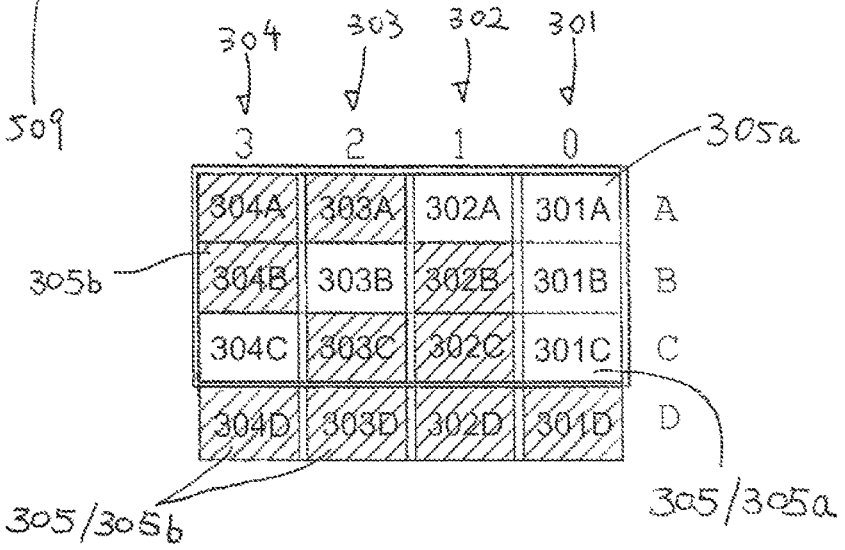
FIG. 5 is a schematic developed view of the surface of the rotor of FIGS. 4A to 4C.
Figure 6A:
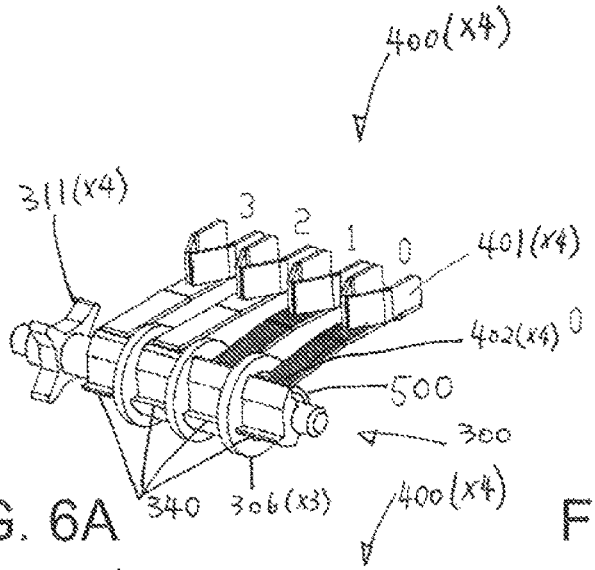
FIGS. 6A, 7A, 8A and 9A are perspective views of the rotor with moving contact of FIGS. 4A, 4B and 4C and four fixed contacts in FIG. 3, showing four switching positions.
Figure 6B:
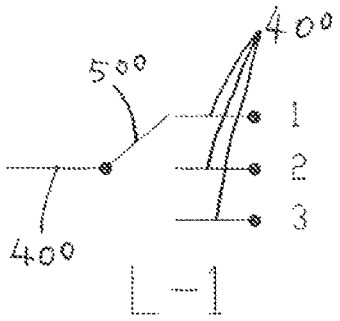
FIGS. 6B, 7B, 8B and 9B are schematic circuit diagrams representing the switching positions of FIGS. 6A, 7A, 8A and 9A, respectively.
Figure 7A:
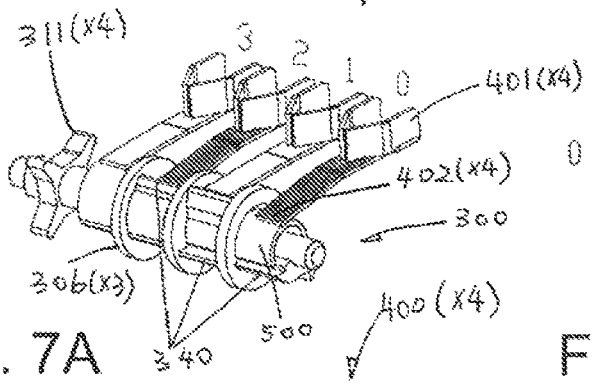
Figure 7B:
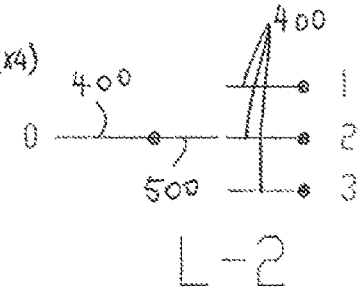
Figure 8A:
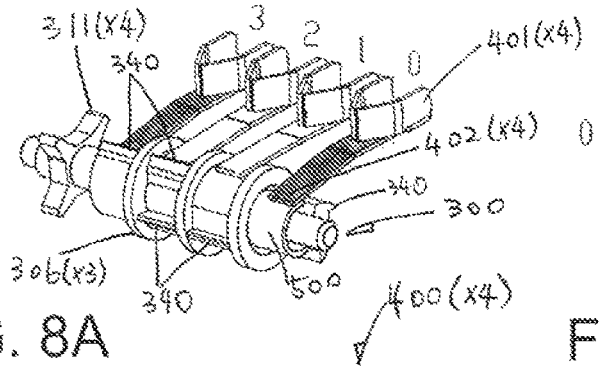
Figure 8B:
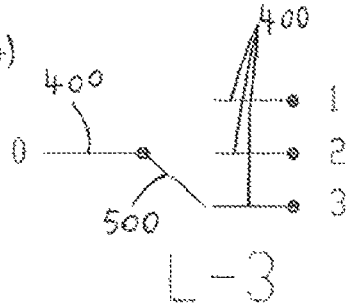
Figure 9A:
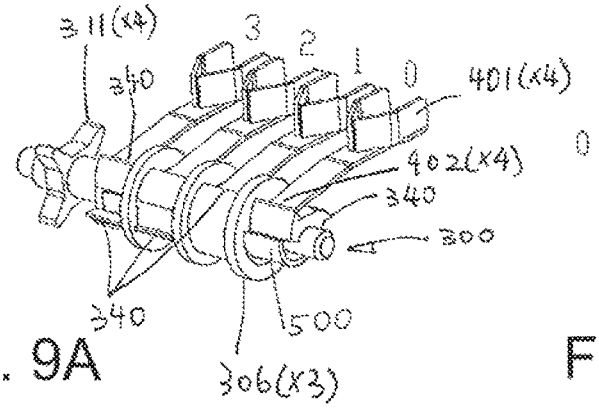
Figure 9B:
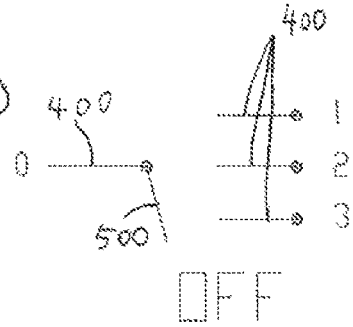

As shown in FIG. 5, the regions 305 may be individually identified by combining the relevant reference numerals in XY coordinate number format, i.e. 301A to 301D, 302A to 302D, 303A to 303D and 304A to 304D. Six of these regions 305, namely regions 301A-301C, 302A, 303B and 304C, collectively 305*a*, are open to expose the corresponding regions of the moving contact 500 embedded in the rotor 300 for contact by the fixed contacts 400 associated/aligned with the relevant sections 301-304 of the rotor 300. The other regions 301D, 302B-302D, 303A, 303C, 303D, 304A, 304B and 304D, collectively 305*b*, are intact, i.e. closed to cover the corresponding regions of the moving contact 500 or block the same against contact by the associated/aligned fixed contacts 400.

The four sections A-D are arranged in a row along the rotor's axis of rotation X, with the open regions 305*a* offset as between adjacent sections. Each flange 306 extends between and separates the open and/or closed regions 305*b* between adjacent sections.

The four fixed contacts 400 are arranged to extend parallel and side by side together, on one side of and in alignment with respective sections A-D of the rotor 300, with their free ends 402 resiliently biased upon the respective sections A-D. In each of the sections A-D, there are at least one open region 305*a* exposing the moving contact 500 and at least one closed region 305*b* covering the moving contact 500, which together extend circumferentially around the rotor 300 for contact making or breaking, i.e. switching action, with the same associated fixed contact 400. The moving contact 500 extends across all of the fixed contacts 400 for performing switching actions with them at different times and/or in different combinations, dependent upon how the open and closed regions 305*a* and 305*b* are arranged in each section for the corresponding fixed contact 400.

The rotor 300 includes at least one inclined protrusion or tooth 340 for abutment by an associated fixed contact 400 against rotational reversal upon release of the operating mechanism 600. The inclined tooth 340 has a cross-section of an inclined triangular shape rising from the surface of the rotor 300, and extends laterally in the direction of the axis of rotation X. More specifically, the inclined tooth 340 extends on and along an edge of a closed region 305*b*. The inclined tooth 340 is inclined or skewed in a direction opposite to the direction of rotation Z of the rotor 300, for counteracting its rotation.

In general, each section of the rotor 300 is formed with at least one such inclined tooth 340 for co-operation with the aligned fixed contact 400. In the described embodiment, there is generally one inclined tooth 340 on each closed region 305*b*, so the $2^{nd}$ to $3^{rd}$ rotor sections 302-304 each have three inclined teeth 340. However, the remaining $1^{st}$ rotor section 301 has two inclined teeth 340, one along each opposite edge of the only closed region 305*b*.

Referring to the casing 200, it has a first, main casing part 210 and a second, minor casing part 220 that closes upon and is snap-fitted with the major casing part 210, together forming the casing 200. The main casing part 210 is partitioned into a large, first compartment 211 holding the fixed contacts 400 and the moving contact 500, and a slim, second compartment 212 holding the operating mechanism 600. The two compartments 211 and 212 are positioned right next to each other.

The minor casing part 220 includes an integrally-connected tube 221 through which the pull chain 90 (i.e. manually-operable member 620) extends out of the casing 200 for manipulation by a user. The tube 221 is externally screw-threaded and is co-operable with an internally screw-threaded nut (not shown) for mounting the overall electrical switch 100 to a part or housing of an electrical appliance for controlling its operation.

The casing 200 has, on opposite first and second sides thereof, a plurality of, e.g. five, openings (holes) 201 and 204. One of the openings, i.e. opening 201, is on the first side that corresponds to the minor casing part 220, through which the manually-operable member 620 is exposed for manipulation by a user. The other four openings 204 are on the second side that corresponds to the main casing part 210, through which electrical cables (not shown) may be inserted for connection to the fixed contacts 400 respectively.

Inside the main casing part 210, the first compartment 211 is partitioned into four separate rooms 214 interconnected by a common area 215. The rooms 214 are made to be oblong and narrow in shape and to extend in a co-parallel arrangement, and also parallel to the second compartment 212 right next door. The rooms 214 have generally the same shape and size and are aligned with one another. Each room 214 holds a respective fixed contact 400, which extends parallel to the room 214 and is inserted therein from inside.

The common area 215 extends transversely across inner open ends of the rooms 214, and is much larger and accommodates the rotor 300 with the moving contact 500. The common area 215 intercepts at right angles with the second compartment 212, with the first end 310 of the rotor 300 therein situated inside the second compartment 212.

Turning now to the operating mechanism 600, it includes ratchet means 610 in ratchet engagement with a rotor part 311 of the rotor 300, and a manually-operable member 620 for operating the ratchet means 610 in a driving direction Z to rotate the rotor 300. The rotor part 311 comprises an annular arrangement of four radial protrusions or spikes 311 on the first end 310 of the rotor 300 around the axis of rotation X. Adjacent spikes 311 subtend an angle of 90°.

The operating mechanism 600 also includes first resilient means in the form of, for example, a compression coil spring 630 which resiliently biases the ratchet means 610 to return in a non-driving direction Z' opposite to the driving direction Z. The manually-operable member 620 is the aforesaid pull chain 90, which has an inner end connected with the ratchet means 610 for pulling the same against the action of the spring 630.

The ratchet means 610 is implemented by a ratchet member in the form of a resilient hook-like pawl 611 that sits in a block 612 which in turn is supported for linear sliding motion in the second compartment 212 of the main casing part 210. The pawl 611 bends to point at an angle of about 45° forward and upward. The pawl 611 is pivotable or bendable downwards against the action of its own resilience (i.e. second resilient means of the operating mechanism 600) but is blocked against pivoting upwards by a pair of hook-shaped prongs 613 covering its back. The pawl 611 and prongs 613 are integral parts of the block 612.

The block 612 with pawl 611 is slidable in opposite directions along the longitudinal extent of the second compartment 212, transversely of the rotor 300 or its axis of rotation X. The block 612 with pawl 611 is resiliently biased by the spring 630 to normally stay innermost of the second compartment 212, at which position of the pawl 611 an adjacent spike 311 is situated in front of the tip of the pawl 611, in the path the tip (FIG. 10A).

Figures 10A, 10B, 10C, 10D, 10E, 10F:
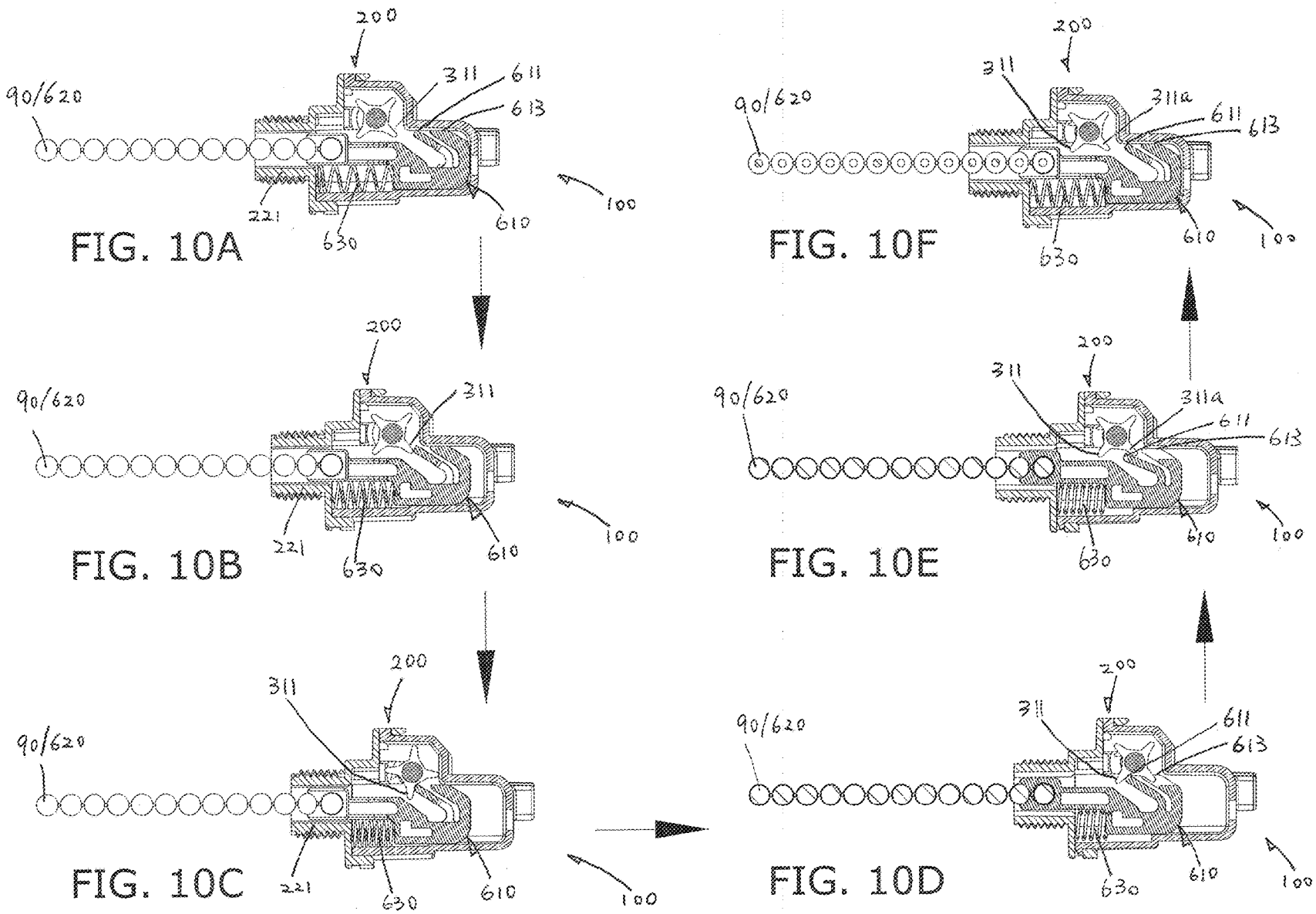
FIGS. 10A, 10B, 10C, 10D, 10E, and 10F are cross-sectional side views of the electrical switch of FIGS. 1 and 2, illustrating sequential steps of a switching action.

Upon pulling of the pull chain 620, the block 612 is pulled to slide forward in the driving direction Z, with the pawl 611 following suit which abuts and pushes the spike 311 (FIG. 10B) and in turn advances the rotor 300 through an angle of 90° (FIGS. 10C to 10D).

The ratchet member 610 includes the hook-shaped prongs 613 covering the back of the pawl 611 as a rigid support for rigidity of the pawl 611 while the pawl 611 is acting upon the rotor spike 311 in the driving direction Z.

Upon release of the pull chain 620, the spring 620 pushes the block 612 to slide backward in the non-driving direction Z', with the pawl 611 following suit which skips past the next spike 311*a* turned round (FIGS. 10E to 10F) while the rotor 300 is being blocked against reversed rotation by some of its inclined teeth 340 abutted by the respective fixed contacts 400 associated therewith.

The next spike 311*a* now replaces the first-mentioned spike 311 for a repeated action by the pawl 611 upon pulling of the pull chain 620 to perform the next switching action.

The stepping switch 100 performs switching actions upon repeated pulling of the pull chain 620 in a cyclic manner through four switching positions as shown in FIGS. 6A-6B, 7A-7B, 8A-8B and 9A-9B. In these diagrams, the fixed contacts 400 are designated "0", "1", "2" and "3" from the first section 301 at the first end 310 to the last section 304 at the second end 320 of the rotor 300.

The fixed contact "0" acts as the pole, so the associated rotor section 301 has only one closed region 305*b*, which corresponds to the switched-off position. Thus, in FIGS. 9A-9B, none of the throws "1" to "3" is connected to the pole "0".

The other three fixed contacts "1", "2" and "3" act as three throws to which the pole is selectively connectable, so the associated rotor sections 301 to 303 have only one open region 305*a*, which correspond to the switching position the respective throws are connected to the pole. Thus, throw "1" is connected to pole "0" in FIGS. 6A-6B, throw "2" is connected to pole "0" in FIGS. 7A-8B, and throw "3" is connected to pole "0" in FIGS. 8A-8B, with the relevant contacts in connection highlighted in grey.

This is a single-pole triple-throw switch design for the stepping switch 100. The switch design is determined by the design and in particular the arrangement of the open and closed regions 305*a* and 305*b* on the rotor 300 for exposing the desired regions of the moving contact 500 for contact by the respective fixed contacts 400 at each of the four angular positions (at 90° apart) of the rotor 300.

The pull chain 620 is releasably connected with the block 612 at a junction 614 which is the frontmost end of the block 612. At this junction 614, a ball socket 614*a* is formed that receives and thus engages the innermost bead of the pull chain 620. The block 612 is fully concealed inside the casing 200, with the junction 614 inside the casing's tube 221 even when the pull chain 620 is being pulled out. To reveal the junction 614 for connecting or disconnecting the pull chain 620, the casing 200 has a wall part right next to the junction 614 made openable (FIG. 3), which is normally closed by a small lid 222 of the same shape and snapped into position.

Reference is now made to FIGS. 11 to 13 of the drawings, there is shown a second electrical switch embodying the invention, which is a very similar stepping switch 900 as the first electrical switch 100*d* described above, with almost identical construction and operation. Equivalent parts are designated by the same reference numerals suffixed by an apostrophe.

The only major difference lies in the use of only two, rather than four, fixed contacts 400', with corresponding changes in the design of the rotor 400', the moving contact 500' and the casing 200'. The rotor 300' and the moving contact 300' are shorter, with the former having only two sections 301' and 302'. The casing 200' is also shorter in the direction across the fixed contacts 400', including only two rooms 214'.

With the exception of the aforesaid components i.e. casing 200', rotor 300' and moving contact 500', all of the other components are identical as in the first electrical switch 100. Accordingly, such components can be shared for use in manufacturing electrical switches of the same type, thereby resulting in substantial saving in production cost and inventory control.

It is noted the design that electrical cables can be connected to the fixed contacts 400 via the openings 204 all on one side of the casing 200, while the pull chain 90/620 is provided on the opposite side, permits placing of the electrical switch 100 in a relatively narrow space in an electrical appliance. This design also allows the electrical cables to extend to the far side or inwardly without the need to turn or bend round the casing 200, thereby simplifying running of the cables.

The invention has been given by way of example only, and various modifications of and/or alterations to the described embodiments may be made by persons skilled in the art without departing from the scope of the invention as specified in the appended claims.

The invention claimed is:

1. An electrical switch comprising:

a casing;

a plurality of fixed contacts and at least one moving contact located in the casing;

a rotor supported in the casing for rotational advancement about an axis of rotation of the rotor to move the moving contact into and out of contact with at least one of the fixed contacts, thereby performing a switching action, wherein the fixed contacts are sequentially arranged along a single straight line that is substantially parallel to the axis of rotation of the rotor, the at least one moving contact is located on and moves with rotation of the rotor, the rotor has a cavity in which the at least one moving contact is located, the cavity has respective open regions through each of which the at least one moving contact is exposed and contactable by a corresponding one of the fixed contacts, and the cavity includes at least one closed region covering and blocking the at least one moving contact from being contacted by the corresponding one of the fixed contacts; and an operating mechanism for rotationally advancing the rotor about the axis of rotation of the rotor.

2. The electrical switch as claimed in claim 1, wherein the fixed contacts are located along the straight line at a regular interval.

3. The electrical switch as claimed in claim 1, wherein at least one of the fixed contacts is elongate and extends transverse to the axis of rotation.

4. The electrical switch as claimed in claim 3, wherein the at least one fixed contact that is elongate and extends transverse to the axis of rotation has opposite first and second ends and is supported at the first end for pivotal movement at the second end by the rotor.

5. The electrical switch as claimed in claim 1, wherein the fixed contacts have substantially the same construction and are arranged in a regular manner.

6. The electrical switch as claimed in claim 1, wherein the at least one moving contact extends across all of the fixed contacts for performing switching actions with respective fixed contacts in a plurality of combinations of the at least one moving contact and at least one corresponding fixed contact at different positions of the rotor as the rotor is rotationally advanced about the rotation axis by the operating mechanism.

7. The electrical switch as claimed in claim 1, wherein one of the open regions and the one of the closed regions which is associated with the same fixed contact, together, extend circumferentially with respect to the rotor.

8. The electrical switch as claimed in claim 7, wherein the respective open region and closed region associated with each of the fixed contacts, together, extend circumferentially with respect to a corresponding section of the rotor, and all sections of the rotor are arranged in a row along the axis of rotation of the rotor, with the open regions offset between adjacent sections of the rotor.

9. The electrical switch as claimed in claim 8, wherein the rotor includes an annular flange extending between and separating adjacent open and/or closed regions.

10. The electrical switch as claimed in claim 1, wherein the rotor includes at least one inclined protrusion for abutment by an associated one of the fixed contacts for preventing rotational reversal of the rotor upon release of the operating mechanism.

11. The electrical switch as claimed in claim 1, wherein the rotor includes at least one inclined protrusion for abutment by an associated one of the fixed contacts for preventing rotational reversal of the rotor upon release of the operating mechanism, and the inclined protrusion extends in the direction of the axis of rotation and on and along an edge of the closed region.

12. The electrical switch as claimed in claim 1, wherein the cavity has an open end through which the at least one moving contact extends into the cavity.

13. The electrical switch as claimed in claim 1, wherein the at least one moving contact has a partially cylindrical body and is fixed to and is coaxial with the rotor.

14. The electrical switch as claimed in claim 13, wherein the partially cylindrical body has a cross-section that extends about the rotor over an angle exceeding 180°.

15. An electrical switch comprising:

a casing;

a plurality of fixed contacts and at least one moving contact located in the casing;

a rotor supported in the casing for rotational advancement about an axis of rotation of the rotor to move the at least one moving contact into and out of contact with at least one of the fixed contacts, thereby performing a switching action, wherein the fixed contacts are sequentially arranged along a single straight line that is parallel to the axis of rotation of the rotor; and an operating mechanism for rotationally advancing the rotor about the axis of rotation of the rotor and including ratchet means in ratchet engagement with a part of the rotor, a manually-operable member for operating the ratchet means in a driving direction for rotational advancement of the rotor, and first resilient means resiliently biasing the ratchet means to return in a non-driving direction that is opposite to the driving direction.

16. The electrical switch as claimed in claim 15, wherein the ratchet means is supported in the casing for linear motion in opposite directions, transverse to the axis of rotation.

17. The electrical switch as claimed in claim 15, wherein the ratchet means comprises a ratchet member arranged to engage the part of the rotor in the driving direction, upon operation by the manually-operable member, and to skip the part of the rotor in the non-driving direction under action of the first resilient means.

18. The electrical switch as claimed in claim 17, including second resilient means, wherein the ratchet member is pivotable against the second resilient means to skip the part of the rotor in the non-driving direction.

19. The electrical switch as claimed in claim 18, wherein the ratchet member includes a rigid support providing rigidity while engaging the part of the rotor in the driving direction.

20. The electrical switch as claimed in claim 15, wherein the part of the rotor comprises protrusions annularly arranged on the rotor, around the axis of rotation.

21. The electrical switch as claimed in claim 20, wherein the part of the rotor is located at an end of the rotor.

22. The electrical switch as claimed in claim 15, wherein the manually-operable member comprises an elongate pliable member connected to the ratchet means.

23. The electrical switch as claimed in claim 22, wherein the elongate pliable member is releasably connected to the ratchet means at a junction.

24. The electrical switch as claimed in claim 23, wherein the casing has a part which is openable to reveal the junction for connecting and disconnecting the elongate pliable member.

25. The electrical switch as claimed in claim 15, wherein the casing has, on opposite first and second sides, a plurality of openings, the manually-operable member is exposed for manipulation by a user through a first of the openings that is located in the first side of the casing, and other openings of the plurality of openings are located on the second side of the casing for insertion of electrical cables for connection to the fixed contacts.

26. The electrical switch as claimed in claim 1 wherein the casing has a first compartment holding the fixed contacts and the at least one moving contact, and a second compartment holding the operating mechanism.

27. The electrical switch as claimed in claim 26, wherein the first compartment is partitioned into separate rooms interconnected by a common area, each room contains a respective fixed contact, and the common area contains the rotor.

28. The electrical switch as claimed in claim 27, wherein the rooms are oblong in shape and extend in a parallel manner.

29. The electrical switch as claimed in claim 27, wherein the rooms have the same shape and size and are aligned with one another.

30. The electrical switch as claimed in claim 26, wherein the casing has a first casing part including the first compartment and the second compartment, and a second casing part that closes upon the first casing part.

31. The electrical switch as claimed in claim 30, wherein the second casing part has an integrally-connected tube through which the manually-operable member extends out of the casing for manipulation by a user, and the tube is externally threaded and co-operable with an internally threaded nut for mounting the electrical switch to an electrical appliance.

* * * * *